US005430959A

United States Patent [19]

Mitsui

[11] Patent Number: 5,430,959

[45] Date of Patent: Jul. 11, 1995

[54] TIGHTENING MEMBER FOR A SHOE

[75] Inventor: Shigeyuki Mitsui, Niigata, Japan

[73] Assignee: Asics Corporation, Hyogo, Japan

[21] Appl. No.: 184,138

[22] Filed: Jan. 21, 1994

[30] Foreign Application Priority Data

Jan. 29, 1993 [JP] Japan ..... 5-013882

[51] Int. Cl.[6] ..... A43B 7/22; A43B 7/14; A43B 5/00

[52] U.S. Cl. ..... 36/88; 36/50.1; 36/114; 36/92; 36/45

[58] Field of Search ..... 36/50.1, 114, 88, 89, 36/45, 91, 92, 58.5, 58.6

[56] References Cited

U.S. PATENT DOCUMENTS

| | | | |
|---|---|---|---|
| D. 341,927 | 12/1993 | Worthington . | |
| D. 342,604 | 12/1993 | Avar . | |
| 1,877,724 | 9/1932 | Gustin | 36/58.5 |
| 3,456,366 | 7/1969 | Boeing | 36/58.5 |
| 4,282,657 | 8/1981 | Antonious | 36/129 |
| 4,366,631 | 1/1983 | Larsen et al. | 36/114 |
| 4,577,419 | 3/1986 | Chassaing | 36/89 |
| 4,670,998 | 6/1987 | Pasternak | 36/114 |
| 4,854,057 | 8/1989 | Misevich et al. | 36/114 |
| 4,972,609 | 11/1990 | Oh et al. . | |
| 4,972,613 | 11/1990 | Loveder . | |
| 4,989,350 | 2/1991 | Bunch et al. | 36/114 |
| 5,269,078 | 12/1993 | Cochrane | 36/50.1 |

FOREIGN PATENT DOCUMENTS

| | | | |
|---|---|---|---|
| 0212032 | 3/1987 | European Pat. Off. | 36/88 |
| 49631 | 3/1939 | France | 36/89 |
| 2162043 | 1/1986 | United Kingdom | 36/88 |

*Primary Examiner*—Steven N. Meyers
*Assistant Examiner*—Marie Denise Patterson
*Attorney, Agent, or Firm*—Nixon & Vanderhye

[57] ABSTRACT

A tightening member for a shoe having two straps disposed on the inner and the outer sides of the shoe and an adjuster disposed on the heel reinforcement portion. One end of the strap has lace holes. The strap is divided into two branches at the other end; one of the branches passes through a hole in the adjuster, and is connected to one end of a lateral strip member of a skeleton-shaped reinforcement portion. The other branch is attached to a stretchable member located on the heel reinforcement portion.

9 Claims, 12 Drawing Sheets

TIGHTENING MEMBER FOR A SHOE

BACKGROUND OF THE INVENTION

1. Field of the Invention

The present invention relates to a tightening member for partially fixing a foot.

2. Description of the Related Art

In general, a conventional shoe has a sole portion, a carapace portion connected to the sole portion, and a tightening member for adjusting fittingness of the carapace portion with the foot.

The tightening member must fix properly the instep portion and heel portion of the foot to enable the shoe to fit the foot, and must be adjustable appropriately.

Athletic shoes must fit properly for athletic function, and particularly it is important to fix the heel portion and ankle portion.

As the conventional tightening member other than a lace of an eyelet portion, there were ones for fixing only the heel portion or the ankle portion, such as an ankle tightening member, a heel tightening member for preventing sprains, or the like. There were no tightening members which tighten simultaneously the heel portion and the ankle portion. Second tightening members each having different functions were required in order to fix the heel portion and the ankle portion. With increase in complexity of the structure of the shoe, the shoe becomes heavier which is contrary to simpleness and lightening required for the shoe.

SUMMARY OF THE INVENTION

It is therefore an object of the present invention to provide a tightening member, which provides a good fit, simplifies the structure of the shoe, facilitates handling of the shoe, and lightens the shoe.

The object of the invention can be achieved by a tightening member comprising a flat adjuster disposed in a heel reinforcement portion of a shoe and having a two holes, a first strap, one end of the first strap being situated in an eyelet portion on an outer side of the shoe, and the other end of the first strap being fixed onto a sole of the shoe through one of the holes on the outer side of the shoe, and a second strap, one end of the second strap being situated in the eyelet portion on an inner side of the shoe, and the other end of the strap being fixed onto the sole through the other one of the holes on the inner side of the shoe.

According to the tightening member of the present invention, the adjuster is disposed in the heel reinforcing portion, both of the first strap and the second strap is disposed in the eyelet portion on a lateral side or a medial side, and the other end of each of the straps is fixed onto the sole of the shoe through a hole of the adjuster. Therefore, the heel portion and the ankle portion can be simultaneously fixed to the shoe by pulling the ends of the first and the second straps, using a lace or the like, thereby achieving the appropriate fit required for athletic shoes, and increasing the shoe's athletic function. In addition, the tightening means of the present invention simplifies the structure of the shoe, facilitates handling of the shoe, and lightens the shoe.

Further objects and advantages of the present invention will be apparent from the following description of the preferred embodiments of the invention as illustrated in the accompanying drawings.

DESCRIPTION OF THE PREFERRED EMBODIMENTS

The preferred embodiments of the present invention will be described with referring to the figures.

Figure 1:
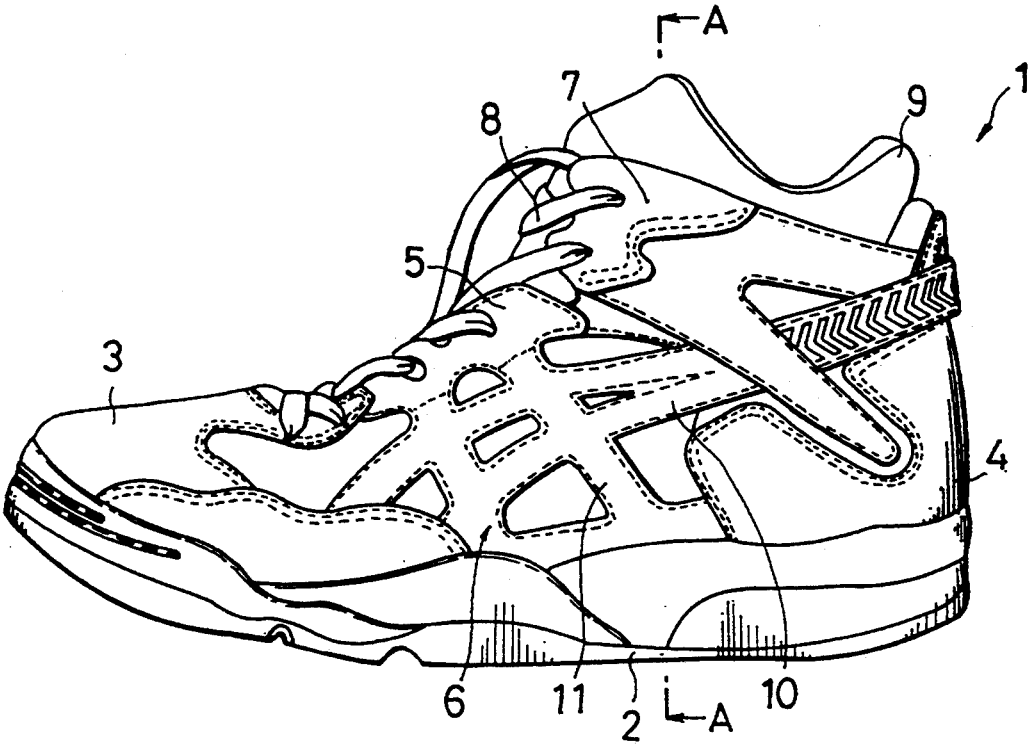
FIG. 1 is a side view of the whole shoes of the present invention.

As shown in FIG. 1, a shoe 1 of the present invention includes a sole 2, a toe reinforcement portion 3, a heel reinforcement portion 4, an eyelet portion 5, a skeleton-shaped reinforcement portion 6, a tightening member 7 for adjusting a fitting from an ankle to a heel portion of the wearer of the shoe, a lace 8 engaging the eyelet portion 5 for adjusting the shoe fit from the toe to the instep portion of a wearer of the shoe, and a sock inner 9 as an internal carapace portion for accommodating and holding the foot of the wearer by covering it, the toe reinforcement portion 3, the heel reinforcement portion 4, the eyelet portion 5, and the skeleton-shaped reinforcement portion 6 constituting an outer carapace portion.

The toe reinforcement portion 3 and the heel reinforcement portion 4 are fixed onto the front and back of the sole 2, respectively. The eyelet portion 5 is connected to the sole 2 through the toe reinforcement portion.

The skeleton-shaped reinforcement portion 6 has a skeleton construction composed of a lateral strip member 10 for connecting the toe reinforcement portion 3 with the heel reinforcement portion 4, and a longitudinal strip member 11 for connecting the sole portion 2 with the eyelet portion 5. The lateral strip member 10 and the longitudinal strip member 11 are disposed on the inner and outer sides of the shoe, and associate with each other to define a plurality of holes. This skeleton-shaped reinforcement portion 8 is completely separated from the sock inner 9, and is dimensioned well enough to connect the sole 2, the toe reinforcement portion 3, the heel reinforcement portion 4 and the eyelet portion 5 with each other to reinforce the shoe.

Figure 2:
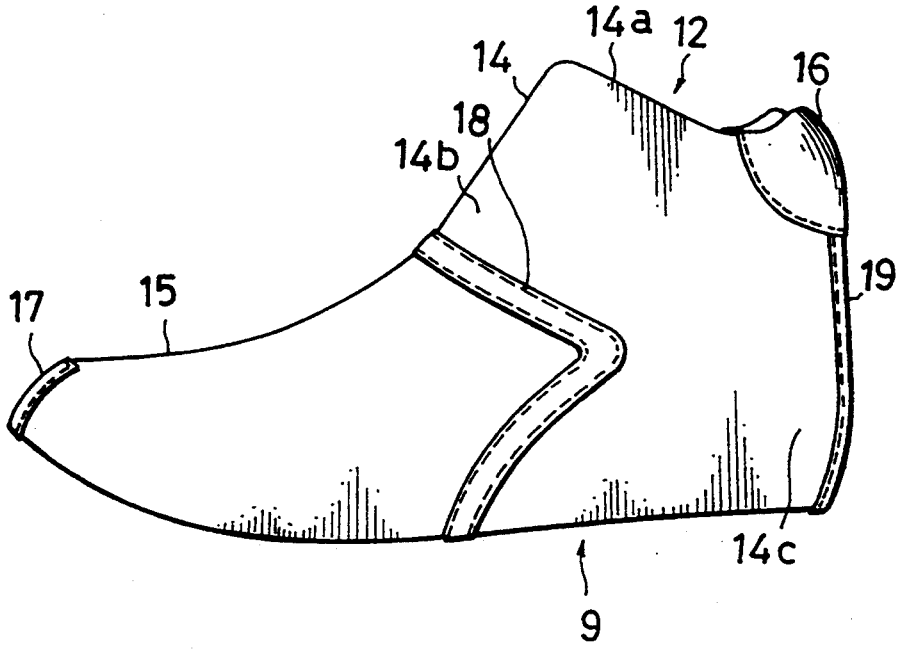
FIG. 2 is a side view of a sock inner of the present invention.

FIG. 2 is a unit assembly of the sock inner 9. The sock inner 9 has a form similar to the foot of the wearer to fit it, and is provided with an opening 12 in an upper portion thereof for allowing the foot to be inserted there through.

Figure 3:
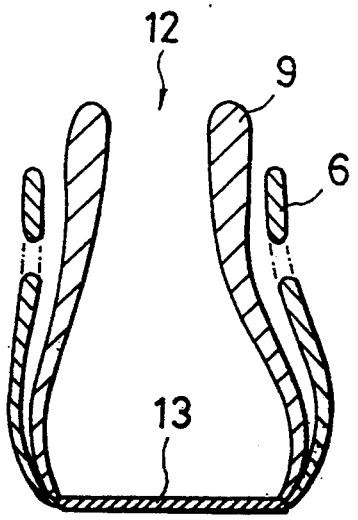
FIG. 3 is a cross-sectional view in line A—A of the shoe in FIG. 1.

As shown in FIG. 3, the sock inner 9 is fixed onto an insole 13 only at a lower edge thereof, and is not sewn together with the outer carapace portion. The upper portion, front and back portions, and side portions of the sock inner 9 are constructed in a free state.

The sock inner 9 is composed of an upper inner 14 for accommodating an arch, the heel and the ankle, a lower inner 15 for accommodating the toe and the arch, a lining 16 for reinforcing a rear portion of an upper peripheral edge portion **14*a* defining the opening 12, a toe protection tape 17, a joint tape 18 for joining the upper inner 14 to the lower inner 15, and a heel protection tape 19**.

Figure 4:
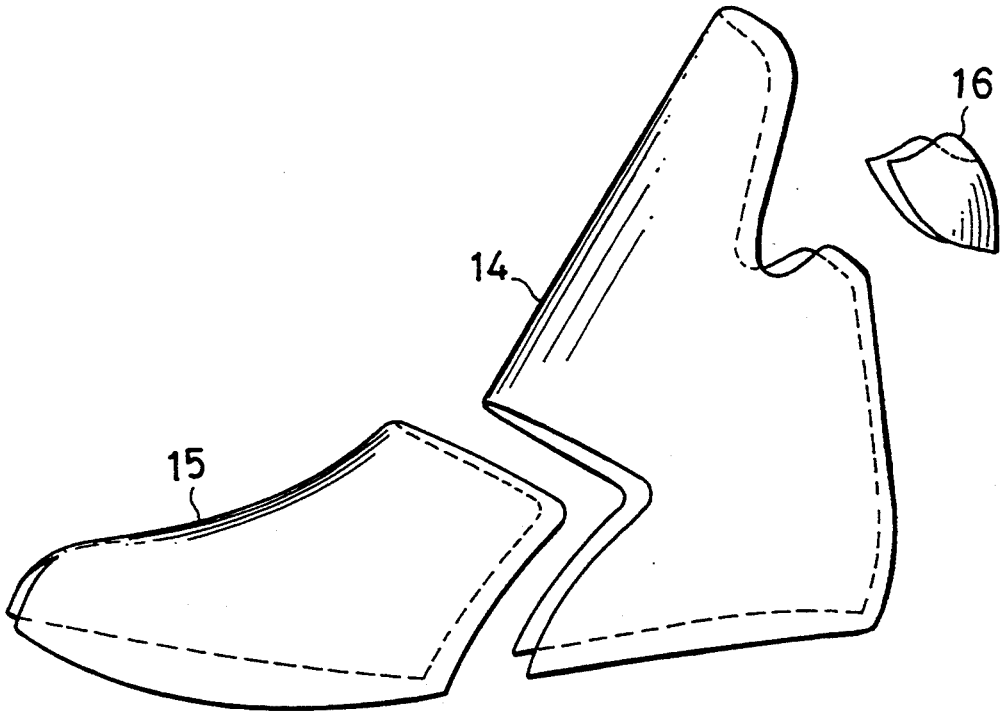
FIG. 4 is a cutting view of the sock inner in FIG. 2.

As shown in FIG. 4, the upper inner 14, the lower inner 15, and the lining 16 have support and stretch properties, and they are cut out tri-dimentionally using a material softer than that of the outer carapace portion like the skeleton-shaped reinforcement portion 6. The upper inner 14 and the lower inner 15 are separated in a transition portion from the ankle to the instep. Such separation face is formed in a zigzag so as to maintain the stretch property of the sock inner 9 after sewing.

Figure 5:
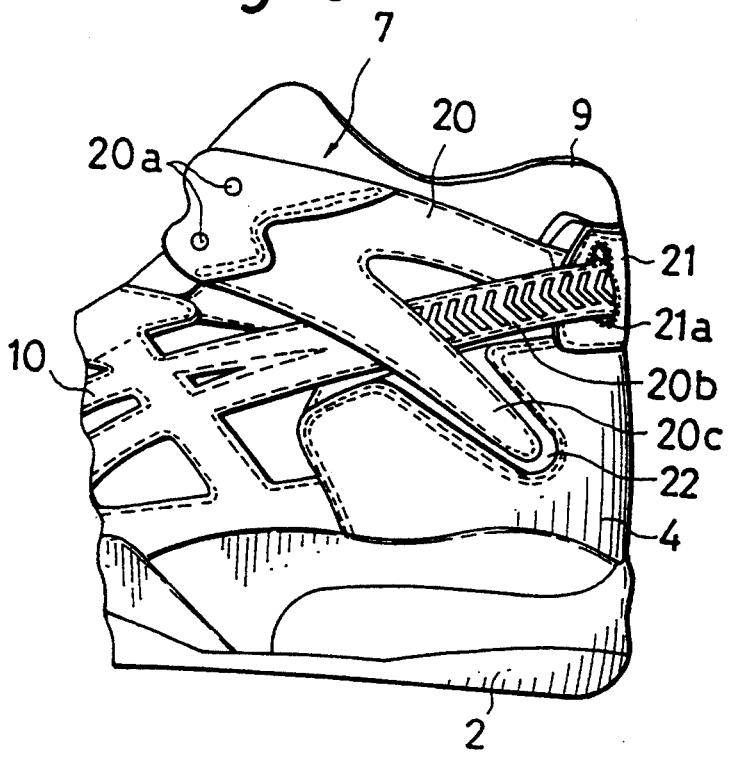
FIG. 5 is a side view of the tightening member of the present invention.
Figure 6:
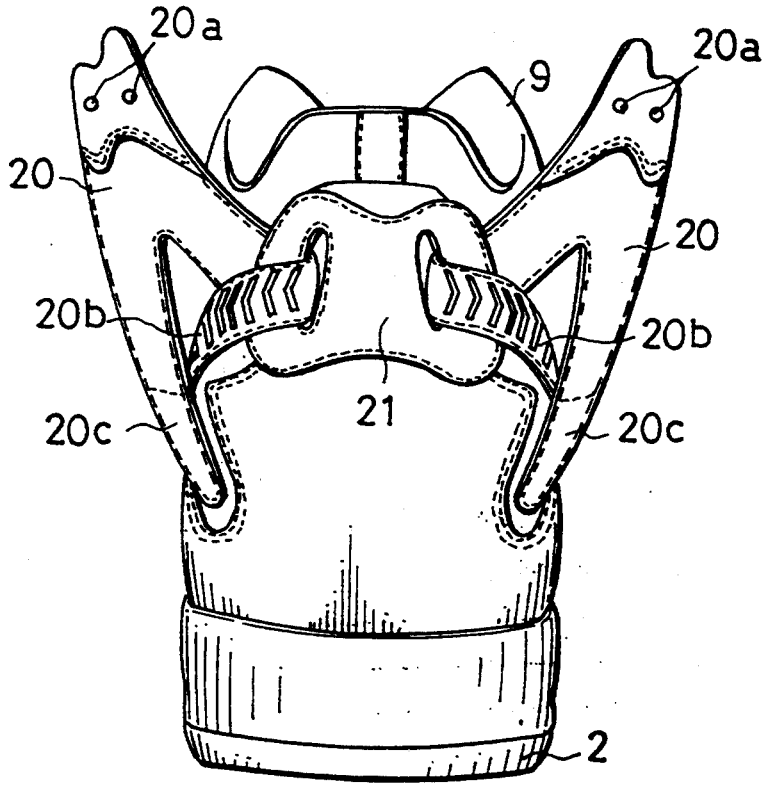
FIG. 6 is a rear view of the tightening member of FIG. 5.

As shown in FIGS. 5 & 6, the tightening member 7 includes two straps 20 disposed on the inner and the outer sides of the shoe 1, two holes 21a, and an adjuster 21 disposed on the heel reinforcement portion 4. The strap 20 is provided at an end thereof with holes **20*a* for allowing the lace 8 to pass therethrough, and the strap 20 is divided into tow branches at the other end. One 20*b* of the branches passes through the adjuster 21, and is integrally connected to one end of the lateral strip member 10 of the skeleton-shaped reinforcement portion 6. The other one 20*c* of the branches is fixed onto a stretch member 22 located on the heel reinforcement portion 4. A tightening direction of the strap 20 can be changed through the intermediary of the stretch member 22** when putting on the shoe.

Usage and functions of the shoe 1 of the embodiments explained with referring to FIGS. 1 to 6, will be described hereinafter.

When putting on the shoe 1, the foot is inserted through the opening 12 of the sock inner 9 from the toe, and is accommodated in the sock inner 9 up to the ankle. After that, when the shoe fits appropriately the foot by adjusting the tightening member with the lace 8, the lace 8 is tied. At that time, the toe and the instep are fixed by the eyelet portion 5, and the ankle and the heel portion are fixed by the tightening member 7.

The sock inner 9 is unitedly formed, matching the shape of the foot. The material having support and stretch properties is almost always used. The sock inner 9 is cut out tri-dimensionally so as not to damage the stretch property. Therefore, the sock inner 9 can support firmly the foot and the ankle can follow up the movement of the foot. Further, there is an appropriate clearance between the sock inner 9 and the foot, so it attenuates stiffness which is liable to be produced in a sock construction.

Further, the sock inner 9 is fixed on the insole 13 at the lower edge thereof and is separated from the outer carapace portion, hence the degree of freedom is large. Deformation, stretch, and contraction are freely realized in accordance with the movement of the foot. Therefore, the fit with the foot and the ankle is improved, and efficiency with the lace and the tightening member is also developed.

Since the sock inner 9 is not sewn together with the outer carapace portion, only a few stitches are required, hence, well-fitting, comfortable feel when wearing the shoe is developed, and even after the long usage, the sock inner 9 does not fray and a cloth material of the sock inner 9 is not torn.

The material of the sock inner 9 preferably has flexibility for fitting the foot by following the movements of the foot, as well as air permeability and a heat retaining property for obtaining comfortableness. The material for reducing the sensible temperature may be also used. The material can be selected from various hard and soft materials, for example, it is selected such that the material of the inside of the opening 12 directly contacting the ankle is softer than that of the outside so as to permit the ankle to feel better.

The fitting property can be further improved by increasing the height of the upper peripheral edge portion **14*a* of the sock inner 9. Therefore, the height of the upper peripheral edge portion 14*a* of the sock inner 9** is determined in accordance with the intended use, such as marathon, basketball or the like, whereby a most suitable shoe can be obtained.

Since the sock inner 9 has in itself certain of functions naturally possessed by the shoe, the outer carapace is simplified.

The skeleton-shaped reinforcement portion 6 has a skeleton construction made only by a lateral strip member 10 and a longitudinal strip member 11 which are dimensioned well enough to connect the sole 2, the toe reinforcement portion 3, the heel reinforcement portion 4, and the eyelet portion 5 with each other and reinforce the shoe. Therefore, a plurality of openings are formed in the reinforcement portion 6 to thereby improve air permeability and lighten the shoe. The skeleton-shaped reinforcement portion 6 is separated from the sock inner 9 and is not fixed thereto, and therefore the portion 6 does not restrain the movement of the sock inner 9.

The strap 20 and the adjuster 21 forming the tightening member 7 are arranged in the heel reinforcement portion 4. When the tightening member 7 is fastened with the lace 8, both the ankle and the heel portion can be fixed, and fitting and fixing properties are improved. So, in particular, the athletic function for various types of athletic race shoes can be accommodated. Further, several functions are fulfilled by one member, therefore, the construction of the shoe can be simplified.

A variation of the present invention will be described hereinafter.

Figure 7:
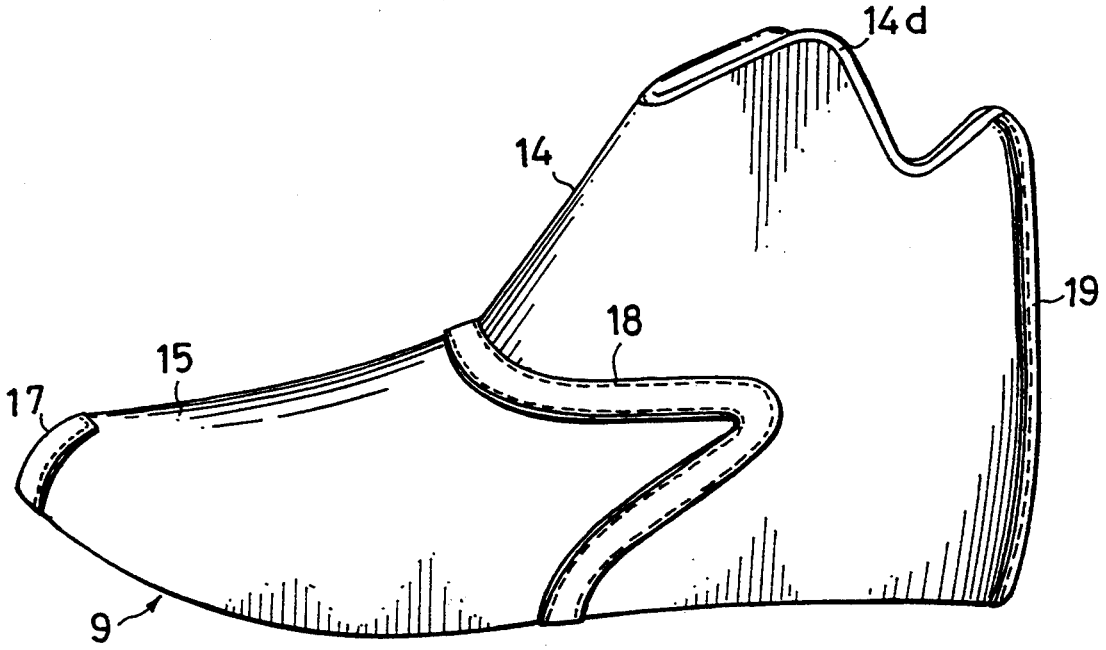
FIG. 7 is a view of a variation of the sock inner of the preset invention.

In FIG. 7, the upper peripheral edge portion **14*d* is formed in zigzag, and the zigzag portion is broadened sufficiently to allow the foot to easily enter the shoe 8**.

Figure 8:
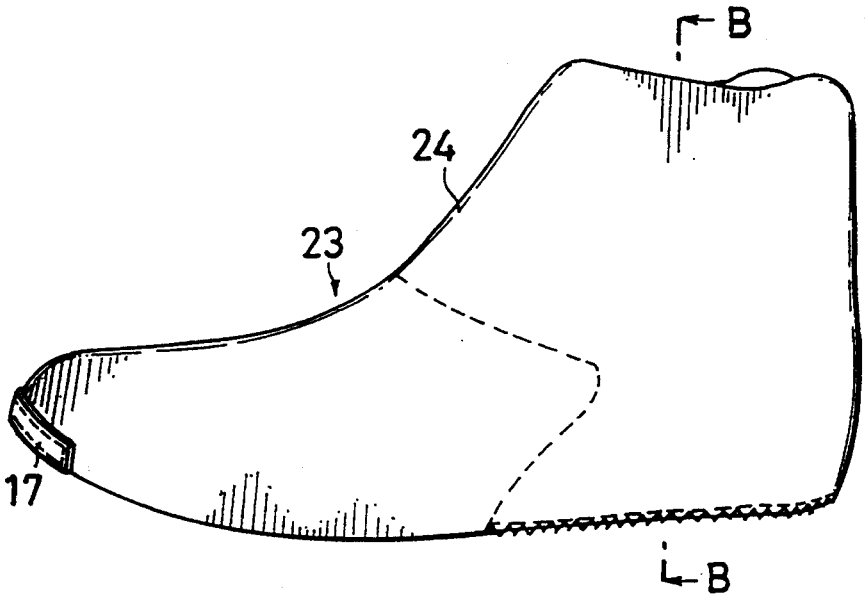
FIG. 8 is a view of another variation of the sock inner of the present invention.
Figure 9:
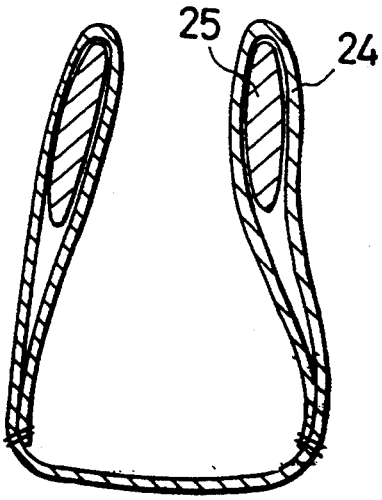
FIG. 9 is a cross-sectional view in line B—B of the sock inner of FIG. 8.

In FIGS. 8 & 9, the sock inner 23 is double-layered on each side face of the inner 24. A sponge 25 is arranged between the two layers to protect and fix the Achilles' tendon.

Figure 10:
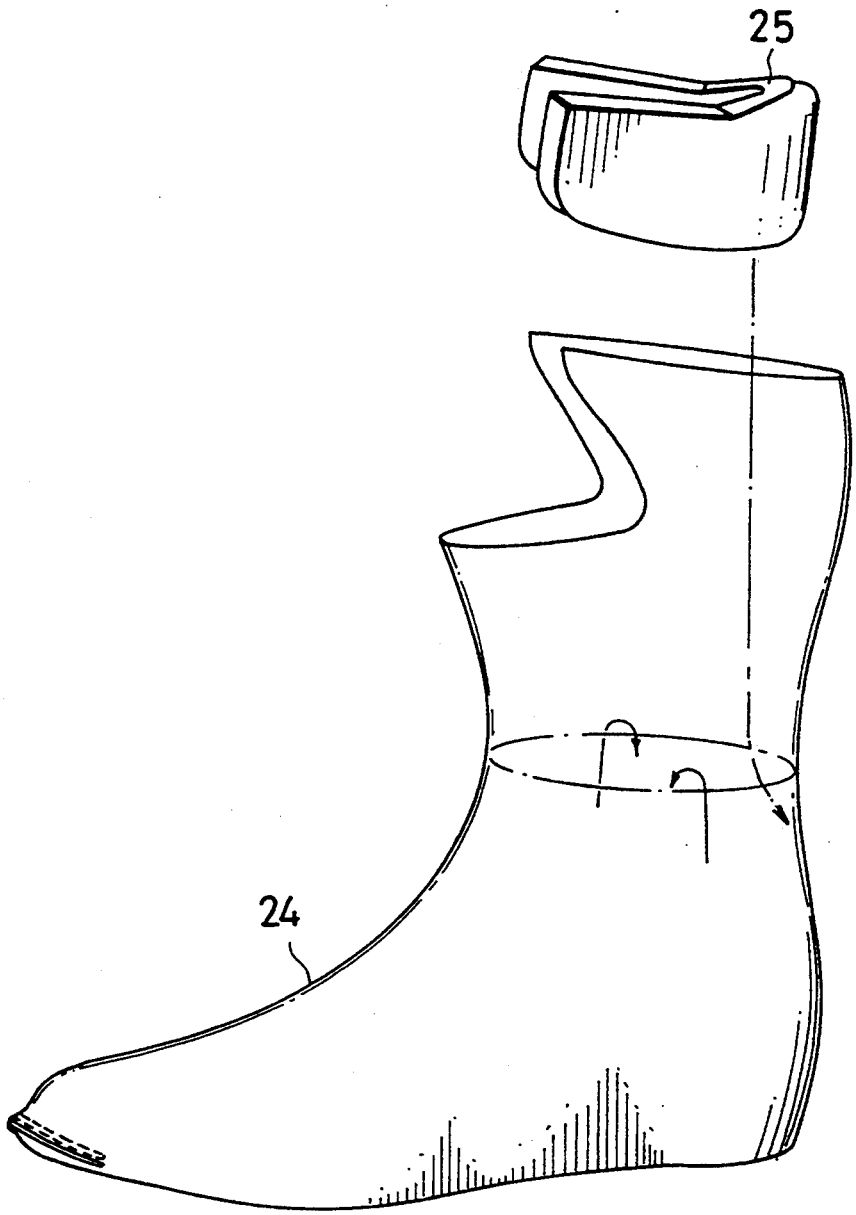
FIG. 10 is an exploded view of the sock inner of FIG. 8.

FIG. 10 shows the sock inner 3 exploded into the inner 24, and the sponge 25. An upper portion of the inner 24 is folded into the inside of the inner 24 while sandwiching the sponge 25 between the two layers.

Figure 11:
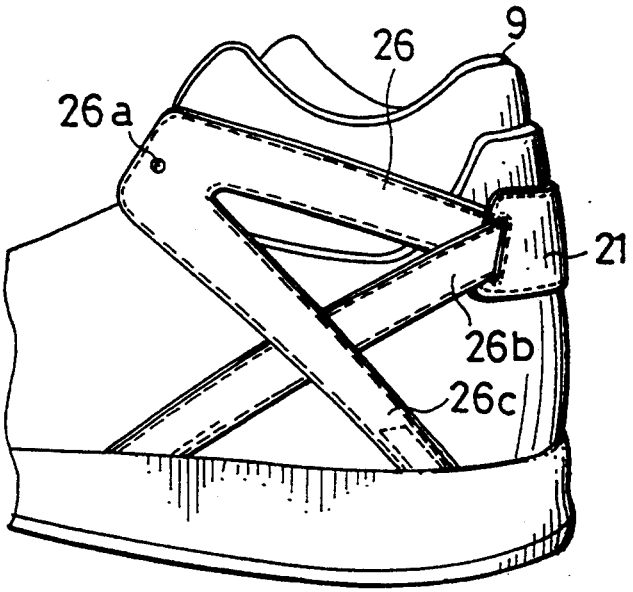
FIG. 11 is a side view of the variation of the tightening member of the present invention.
Figure 12:
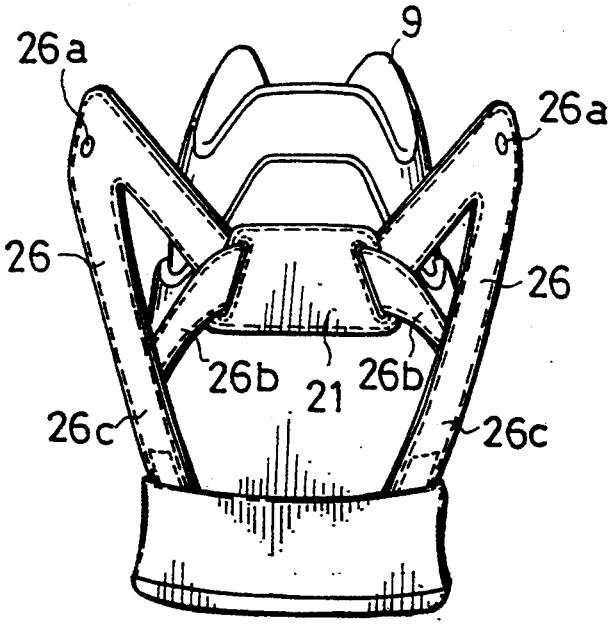
FIG. 12 is a rear view of FIG. 11.

FIG. 11 and FIG. 12 show a variation of the tightening member. One 26*b* of two branches of the strap 26 is fixed through the adjuster 21 to the sole 2, and the other one 26*c* of two branches is fixed onto the sole 2 directly.

Figure 13:
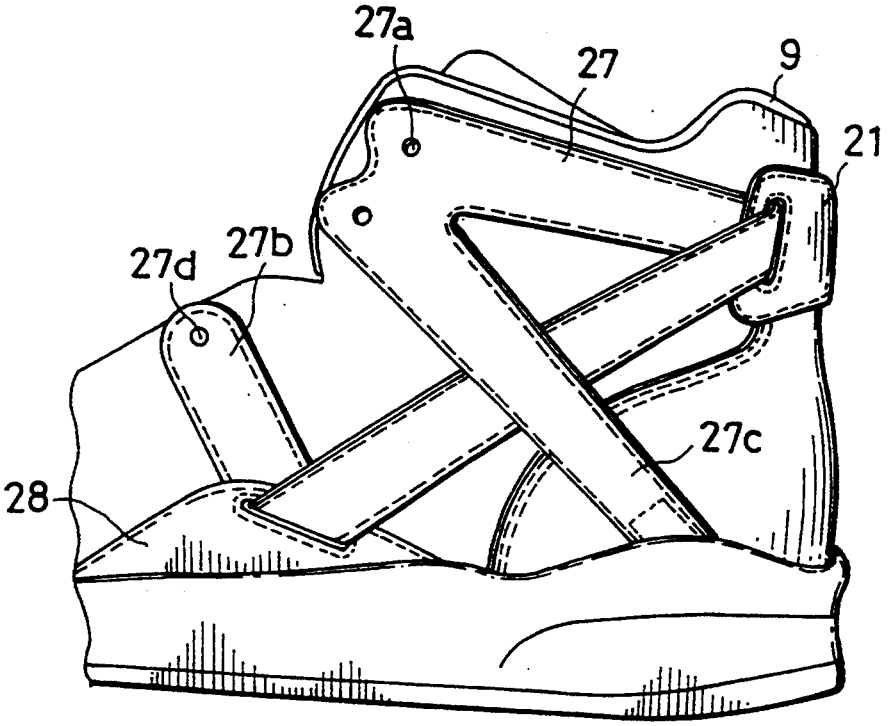
FIG. 13 is a view of another variation of the tightening member of the present invention.

In FIG. 13, one 27*b* of the branches of the strap 27 is extended to the eyelet portion 5 through the adjuster 21 and a support portion 28 located on the sole.

Figure 14:
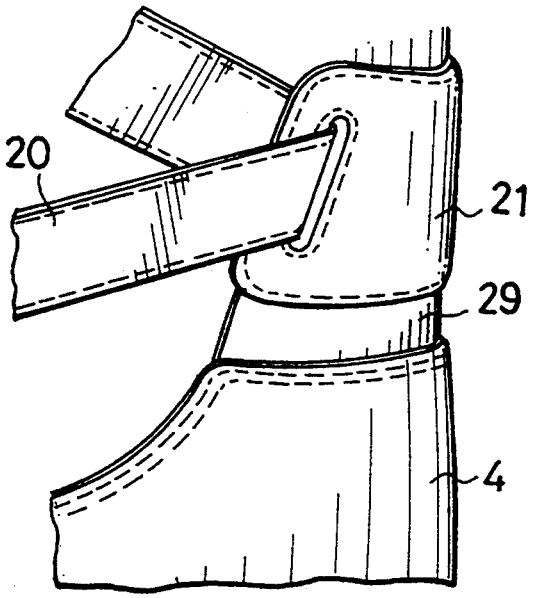
FIG. 14 is a view of a variation of an adjuster of the present invention.

In FIG. 14, a lower edge of the adjuster 21 is coupled to the heel reinforcement portion 4 through a stretch member 29.

Figure 15:
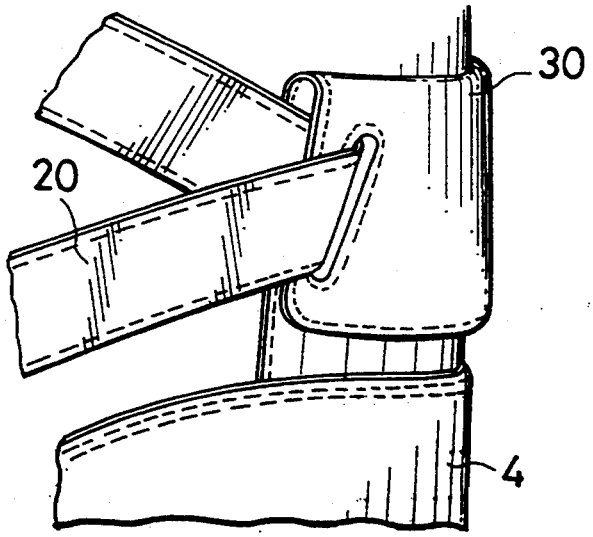
FIG. 15 is a view of another variation of the adjuster of the present invention.

In FIG. 15, a lower edge of the adjuster 30 is fixed onto the heel reinforcement portion 4, and an upper edge of the adjustment is turned down to form the adjuster.

Figure 16:
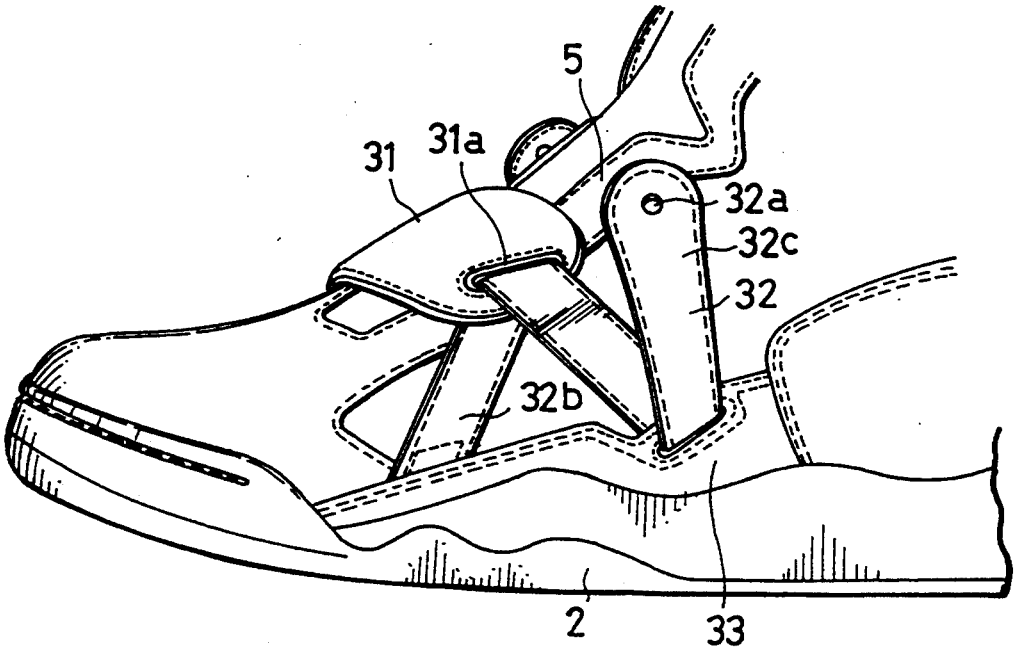
FIG. 16 is a view of still another variation of the tightening member of the present invention.

In FIG. 16, the tightening member of the present invention is utilized for tightening the instep and the arch portion. The adjuster 31 is arranged on the eyelet portion 5. One end 32*b* of the strap 32 is fixed on the sole 2, while the other end 32*c* of the strap 32 is passed through the hole 31*a* of the adjuster 31, and is extended to the eyelet portion 5 through the support portion 33. Thus, various tightenings are possible by changing the arrangement of the adjuster and combination of the strap with the adjuster.

Figure 17:
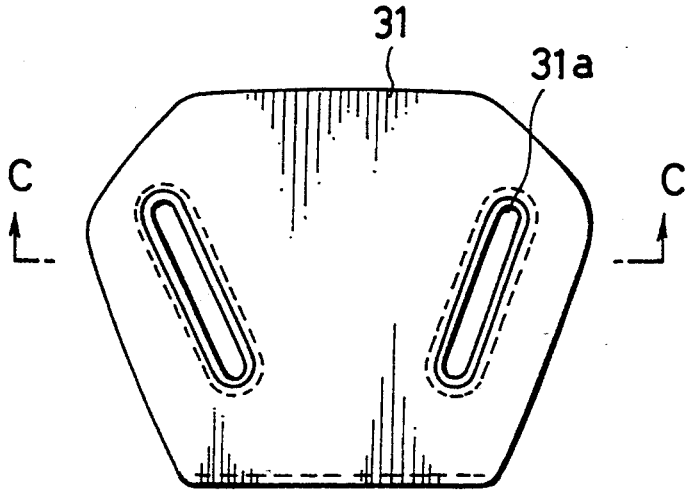
FIG. 17 is a view showing a unit of the adjuster of FIG. 16.
Figure 18:
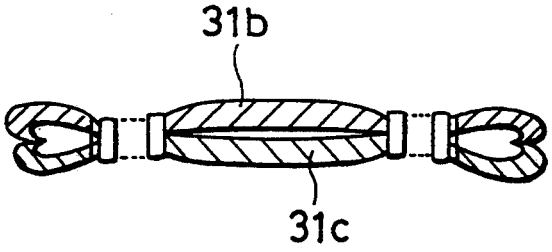
FIG. 18 is a cross-sectional view in line C—C of FIG. 16.

FIGS. 17 & 18 show a unit of the adjuster 31 used for the tightening member of FIG. 16, and a cross-sectional view of the unit of FIG. 16, respectively. The adjustment 31 has a double-layered structure consisting of an artificial leather layer 31*b* and a polyester fiber 31*c*. Thus, the well-fitting feel can be adjusted.

It will be easily understood that the present invention can be applied to not only particular shoes such as the athletic shoes, but also shoes of various types such as townshoes.

Many widely different embodiments of the present invention may be constructed without departing from the spirit and scope of the present invention. It should be understood that the present invention is not limited to the specific embodiments described in the specification, except as defined in the appended claims.

What is claimed is:

1. A tightening member in combination with a shoe comprising:

a flat adjuster disposed in a heel reinforcement portion of a shoe, said adjuster having two holes;

a first strap disposed on a lateral side of the shoe, one end of said first strap having an eyelet portion, and the other end of said first strap being fixed to a sole of said shoe through one of said adjuster holes; and a second strap disposed on a medial side of the shoe, one end of said second strap having an eyelet portion, and the other end of said second strap being fixed to said sole through the other of said adjuster holes.

2. A tightening member according to claim 1, wherein the respective ends of said first strap and said second strap are tightened by a lace together with said eyelet portion.

3. A tightening member according to claim 1 wherein at least one end of both of said first strap and said second strap is divided into two branches, one of said branches is fixed to the sole of the shoe through one of the holes of said adjuster, and the other branch is fixed directly to the sole of the shoe.

4. A tightening member according to claim 1 wherein said sole wherein said sole has a support portion having a hole, at least one end of both of said first strap and said second strap is divided into two branches, one of said branches is attached to said eyelet portion through the hole of said adjuster and the hole of said support portion, and the other branch is fixed directly to the sole of the shoe.

5. A tightening member according to claim 1, wherein the shoe has a heel reinforcement portion and a stretch member and said adjuster is connected to the heel reinforcement portion through a stretch member.

6. A tightening member according to claim 1, wherein said adjuster is fixed to the sole.

7. A tightening member according to claim 1, wherein said adjuster is formed of a sponge layer, an outer layer and an inner layer.

8. A tightening member in combination with a shoe comprising:

a flat adjuster disposed in a carapace portion of a shoe, said adjuster having two holes;

a first strap disposed on a lateral side of the shoe, one end of said first strap having an eyelet portion, and the other end of said first strap being fixed to a sole of said shoe through one of said adjuster holes; and a second strap disposed on a medial side of the shoe, one end of said second strap having an eyelet portion, and the other end of said second strap being fixed to said sole through the other of said adjuster holes.

9. A tightening member according to claim 8, wherein the respective ends of said first strap and said second strap are tightened by a lace together with said eyelet portion.

* * * * *